US007951468B2

(12) United States Patent
Chu et al.

(10) Patent No.: US 7,951,468 B2
(45) Date of Patent: May 31, 2011

(54) METHOD OF UNIDIRECTIONAL SOLIDIFICATION OF CASTINGS AND ASSOCIATED APPARATUS

(75) Inventors: Men G. Chu, Export, PA (US); Ho Yu, Murrysville, PA (US); Alvaro Giron, Murrysville, PA (US); Kenneth Joseph Kallaher, Trafford, PA (US); Jeffrey J. Shaw, New Kensington, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 12/059,620

(22) Filed: Mar. 31, 2008

(65) Prior Publication Data

US 2008/0182122 A1 Jul. 31, 2008

Related U.S. Application Data

(60) Division of application No. 11/484,276, filed on Jul. 11, 2006, now Pat. No. 7,377,304, which is a continuation-in-part of application No. 11/179,835, filed on Jul. 12, 2005, now Pat. No. 7,264,038.

(51) Int. Cl.
*B32B 15/20* (2006.01)

(52) U.S. Cl. ..... 428/654; 428/615; 428/939

(58) Field of Classification Search ..... None
See application file for complete search history.

(56) References Cited

U.S. PATENT DOCUMENTS 2,244,367 A * 6/1941 Kinkead ..... 164/93
2,301,902 A * 11/1942 Merle ..... 164/461
3,206,808 A * 9/1965 Robinson ..... 164/461
3,752,212 A * 8/1973 Thompson ..... 164/93
4,210,193 A 7/1980 Ruhle (Continued)

FOREIGN PATENT DOCUMENTS

GB 8490 A 4/1913

(Continued)

OTHER PUBLICATIONS

Official Action from the United States Patent and Trademark Office for U.S. Appl. No. 11/179,835 dated Oct. 12, 2006.

(Continued)

*Primary Examiner* — John J Zimmerman
(74) *Attorney, Agent, or Firm* — Greenberg Traurig, LLP

(57) ABSTRACT

Molten metal is injected uniformly into a horizontal mold from a feed chamber in a horizontal or vertical direction at a controlled rate, directly on top of the metal already within the mold. A cooling medium is applied to the bottom surface of the mold, with the type and flow rate of the cooling medium being varied to produce a controlled cooling rate throughout the casting process. The rate of introduction of molten metal and the flow rate of the cooling medium are both controlled to produce a relatively uniform solidification rate within the mold, thereby producing a uniform microstructure throughout the casting, and low stresses throughout the casting. A multiple layer ingot product is also provided comprising a base alloy layer and at least a first additional alloy layer, the two layers having different alloy compositions, where the first additional alloy layer is bonded directly to the base alloy layer by applying the first additional alloy in the molten state to the surface of the base alloy while the surface temperature of the base alloy is lower than the liquidus temperature and greater than eutectic temperature of the base alloy −50 degrees Celsuis.

20 Claims, 17 Drawing Sheets

Brazing Sheet

U.S. PATENT DOCUMENTS

| | | | | | |
|---|---|---|---|---|---|
| 4,567,936 | A | * | 2/1986 | Binczewski | 164/453 |
| 4,585,047 | A | | 4/1986 | Kawai et al. | |
| 4,607,680 | A | | 8/1986 | Mills et al. | |
| 4,969,502 | A | | 11/1990 | Mawer et al. | |
| 5,020,583 | A | | 6/1991 | Aghajanian et al. | |
| 5,074,353 | A | | 12/1991 | Ohno | |
| 5,476,725 | A | * | 12/1995 | Papich et al. | 428/654 |
| 5,524,700 | A | | 6/1996 | Gosch | |
| 6,495,269 | B1 | * | 12/2002 | Haszler et al. | 428/610 |
| 6,705,384 | B2 | * | 3/2004 | Kilmer et al. | 164/461 |
| 7,264,038 | B2 | | 9/2007 | Chu et al. | |
| 7,377,304 | B2 | | 5/2008 | Chu et al. | |
| 7,472,740 | B2 | | 1/2009 | Anderson et al. | |
| 7,485,255 | B2 | | 2/2009 | Chretien | |
| 7,516,637 | B2 | | 4/2009 | Scamans et al. | |
| 7,516,775 | B2 | | 4/2009 | Wagstaff et al. | |
| 7,547,463 | B2 | | 6/2009 | Davisson et al. | |
| 7,569,525 | B2 | | 8/2009 | Heenan et al. | |
| 7,608,302 | B2 | | 10/2009 | Bischoff et al. | |
| 7,617,864 | B2 | | 11/2009 | Gallerneault | |
| 7,624,609 | B2 | | 12/2009 | Ball et al. | |
| 7,648,674 | B2 | | 1/2010 | Charpientier et al. | |
| 7,748,434 | B2 | | 7/2010 | Wagstaff | |
| 7,762,310 | B2 | | 7/2010 | Bull et al. | |
| 7,789,124 | B2 | | 9/2010 | Gallerneault | |
| 7,789,254 | B2 | | 9/2010 | Geho | |
| 7,789,978 | B2 | | 9/2010 | Ward | |
| 7,819,170 | B2 | | 10/2010 | Anderson et al. | |
| 7,823,623 | B2 | | 11/2010 | Fitzsimon et al. | |
| 2003/0165709 | A1 | * | 9/2003 | Gazapo et al. | 428/654 |
| 2006/0185816 | A1 | | 8/2006 | Anderson et al. | |
| 2007/0106155 | A1 | | 5/2007 | Goodnow et al. | |
| 2007/0193714 | A1 | | 8/2007 | Barker et al. | |
| 2007/0209778 | A1 | | 9/2007 | Gallerneault et al. | |
| 2007/0250000 | A1 | | 10/2007 | Magnin et al. | |
| 2008/0000608 | A1 | | 1/2008 | Chu et al. | |
| 2008/0029191 | A1 | | 2/2008 | Simpson et al. | |
| 2008/0287801 | A1 | | 11/2008 | Magnin et al. | |
| 2009/0007994 | A1 | | 1/2009 | Zhao et al. | |
| 2009/0081072 | A1 | | 3/2009 | Zhao et al. | |
| 2009/0145569 | A1 | | 6/2009 | Anderson et al. | |
| 2010/0201155 | A1 | | 8/2010 | Bassi et al. | |

FOREIGN PATENT DOCUMENTS

| | | | | |
|---|---|---|---|---|
| GB | 08490 | | | 6/1914 |
| JP | 56 077049 | | | 6/1981 |
| JP | 56-77049 | A | | 6/1981 |
| JP | 58 032543 | | | 2/1983 |
| JP | 58-32543 | A | | 2/1983 |
| JP | 61 169138 | | | 7/1986 |
| JP | 61-169138 | A | | 7/1986 |
| JP | 63-49357 | | * | 3/1988 |
| JP | 64-66061 | A | | 3/1989 |
| JP | 1-113164 | | | 5/1989 |
| JP | 2002-263799 | | * | 9/2002 |
| JP | 2003 145249 | | | 5/2003 |
| JP | 2003-145249 | A | | 5/2003 |
| JP | 1 066061 | | | 6/2005 |
| JP | 2005 144482 | | | 6/2005 |
| JP | 2005-144482 | A | | 6/2005 |
| WO | 02/18076 | | | 3/2002 |
| WO | 02/18076 | A | | 3/2002 |

OTHER PUBLICATIONS

Official Action from the United States Patent and Trademark Office for U.S. Appl. No. 11/179,835 dated May 23, 2006.

Official Action from the United States Patent and Trademark Office for U.S. Appl. No. 11/484,276 dated May 31, 2007.

Official Action from the United States Patent and Trademark Office for U.S. Appl. No. 11/484,276 dated Apr. 9, 2007.

Official Action from the United States Patent and Trademark Office for U.S. Appl. No. 11/765,753 dated Dec. 28, 2007.

International Search Report from PCT/US2006/027348 dated May 30, 2007.

U.S. Appl. No. 12/470,415, filed on May 21, 2009.

U.S. Appl. No. 12/781,372, filed on May 17, 2010.

European Search Report from European Patent Application No. 10 18 4881 dated Jan. 14, 2011.

European Search Report from European Patent Application No. 10 15 8205 dated Jun. 30, 2010.

* cited by examiner

Skin Sheet

Brazing Sheet

METHOD OF UNIDIRECTIONAL SOLIDIFICATION OF CASTINGS AND ASSOCIATED APPARATUS

CROSS-REFERENCE TO RELATED APPLICATIONS

This is a division of U.S. application Ser. No. 11/484,276, filed Jul. 11, 2006 (now U.S. Pat. No. 7,377,304), which is a continuation-in-part of U.S. application Ser. No. 11/179,835, filed Jul. 12, 2005 (now U.S. Pat. No. 7,264,038), the entire disclosures of which are hereby incorporated by reference.

BACKGROUND OF THE INVENTION

1. Field of the Invention

The present invention relates to a multiple layer ingot product formed by casting. More specifically, the present invention provides an ingot cast by an apparatus and method of unidirectionally solidifying castings to provide a uniform solidification rate, thereby providing a casting having a uniform microstructure and lower internal stresses. This method produces castings reflecting planar unidirectional solidification.

2. Description of the Related Art

Various methods of directional solidification of castings within a mold have been attempted in an effort to improve the properties of castings.

An example of a presently available directional solidification method includes U.S. Pat. No. 4,210,193, issued to M. Ruhle on Jul. 1, 1980, disclosing a method of producing an aluminum silicone casting. The molten material is poured into a mold having a bottom formed by a tin plate. A stream of water is applied to the bottom of the tin plate, and a thermocouple inserted through the tin plate into the casting is used to monitor the temperature of the casting, and thereby properly control the cooling stream. Cooling is stopped when the temperature in the bottom portion of the mold falls from 575° F. to 475° F., until heat from the surrounding melt increases this region to 540° F. When the aluminum silicone alloy is removed from the mold, the tin plate has become a part of the casting. The result is a fine grain structure in the lower portion of the casting. This method fails to produce a uniform structure with low stresses, and would likely result in waste due to the necessity of cutting away the tin plate if it is not to form a part of the final casting.

U.S. Pat. No. 4,585,047, issued to H. Kawai et al. on Apr. 29, 1986, discloses an apparatus for cooling molten metal within a mold. The apparatus includes a pipe within the mold through which a cooling liquid is passed. The pipe is located in a lower portion of the mold, resulting in directional solidification of the metal from the bottom of the mold to the top. Once the casting is solidified, the excess portion of the casting is cut away from the casting, and then melted away from the pipe so that the pipe can be reused. The necessity of cutting away the portion of the casting surrounding the pipe results in added manufacturing steps and waste. The apparatus further fails to provide for a uniform structure within the casting or the low stresses within the casting that would result from a directional solidification.

U.S. Pat. No. 4,969,502, issued to Eric L. Mawer on Nov. 13, 1990, discloses an apparatus for casting of metals. The apparatus includes an elongated pouring device structured to pour molten metal against a vertical plate, thereby dissipating the energy of the flowing molten metal. Alternatively, a pair of elongated pouring devices are used to pour molten metal towards each other, so that the interaction of the two strains of metal flowing towards each other dissipates the energy of the metal. The result is a reduced wave action within the mold, so that the cooled casting has a more uniform thickness. The apparatus fails to provide for a uniform structure within the casting. It also fails to provide low stresses within the casting.

U.S. Pat. No. 5,020,583, issued to M. K. Aghajanian et al. on Jun. 4, 1991, describes the directional solidification of metal matrix composites. The method includes placing a metal ingot above a mass of filler material and then melting the metal so that the metal infiltrates the filler material. The metal may be alloyed with infiltration enhancers such as magnesium, and the heating may be done within a nitrogen gas environment to further facilitate infiltration. After infiltration, the resulting metal matrix is cooled by placing it on top of a heat sink, with insulation placed around the cooling metal matrix, thereby resulting in directional solidification of the molten alloy. This patent fails to provide for control of the rate of solidification, for a uniform structure within the casting, or for low stresses within the casting.

U.S. Pat. No. 5,074,353, issued to A. Ohno on Dec. 24, 1991, discloses an apparatus and method for horizontal continuous casting of metal. The system includes a holding furnace connected to a hot mold having an open section at its inlet end. Heating elements around the sides and bottom of the hot mold heat the mold to a temperature that is at least the solidification temperature of the casting metal. A cooling spray is applied to the top of the hot mold. A dummy member secured between upper and lower pinch rollers is reciprocated into and out of the outlet end of the mold to draw out the metal as it is solidified. The method of this patent is likely to result in waste due to the need to separate the casting from the dummy metal. The apparatus further fails to provide for a uniform structure within the casting or the low stresses within the casting that would result from a directional solidification.

Accordingly, there is a need for an improved apparatus and method of unidirectional solidifying of casting, providing for a relatively uniform, controlled cooling rate. Such a method would result in greater uniformity within the crystal structure of the casting, with lower stresses within the casting, and a reduced tendency towards cracking.

SUMMARY OF THE INVENTION

A multiple layer cast ingot formed by a method of unidirectionally solidifying a casting across the thickness of the casting, at a controlled solidification rate is provide. The method is particularly useful for casting commercial size ingots of 2xxx series aluminum alloys cladded with a 1xxx alloy and a 3xxx alloy cladded with a 4xxx alloy. For purposes of this description, thickness is defined as the thinnest dimension of the casting.

A mold in accordance with the invention is preferably oriented substantially horizontally, having four sides and a bottom that may be structured to selectively permit or resist the effects of a coolant sprayed thereon. One bottom configuration is a substrate having holes of a size that allow coolants to enter but resist the exit of molten metal. Such holes are preferably at least about 1/64 inch in diameter, but not more than about one inch in diameter. Another bottom configuration is a conveyor having a solid section and a mesh section. Other bottom configurations include structures to be removed from the remainder of the mold upon solidification of the molten metal on the bottom of the mold, with a mesh, cloth, or other permeable structure remaining to support the casting.

A trough for transporting molten metal from the furnace terminates at one side of the mold, and is structured to transport metal from the furnace or other receptacle to a molten metal feed chamber disposed along one side of the mold. In another embodiment, the molten feed chamber is disposed along the top of one side of the mold so that it is possible to deliver the molten metal vertically to the top of the mold cavity in a controlled manner. The molten metal feed chamber and mold are separated from each other by one or more gates. A preferred gate is a cylindrical, rotatably mounted gate, defining a helical slot therein, so that as the gate rotates, molten metal is released horizontally into the mold, only at the level of the top of the molten metal within the mold. Another preferred gate is merely slots at different heights in the wall separating the mold and feed chamber, so that the rate at which molten metal is added to the feed chamber determines the rate and height at which molten metal enters the mold. Another preferred gate is a flow passage between the molds and the feed chamber having a vertical slider at each end, so that the vertical slider resists the flow of molten metal through a slot in both the mold and the feed chamber, while permitting the flow of molten metal through the channel. The flow of molten metal is thereby limited to a desired height within the mold, set by the height of the channel.

In some embodiments, a second trough and molten metal feed chamber may be provided on another side of the mold, thereby permitting a second alloy to be introduced into the mold during casting of a first alloy, for example, to apply a cladding to a cast item. This procedure may be extended to make a multiple layer ingot product having at least two different alloy layers. The sides of the mold are preferably insulated. A plurality of cooling jets, for example, air/water jets, will be located below the mold, and are structured to spray coolant against the bottom surface of the mold.

Molten metal is introduced substantially uniformly through the gates. At the same time, a cooling medium is applied uniformly over the bottom area of the mold. The rate at which molten metal flows into the mold, and the rate at which coolant is applied to the mold, are both controlled to provide a relatively constant rate of solidification. The coolant may begin as air, and then gradually be changed from air to an air-water mist, and then to water. After the molten metal at the bottom of the mold solidifies, the bottom of the substrate may be moved so that the solid section underneath the mold is replaced by a section having openings, thereby permitting the coolant to directly contact the solidified metal, and maintain a desired cooling rate. In the case of a perforated plate substrate, the mold bottom need not be removed.

Accordingly, it is an object of the present invention to provide an improved method of directionally solidifying castings during cooling.

It is another object of the invention to provide a method of maintaining a relatively constant solidification rate during the solidification of the casting.

It is a further object of the invention to provide a casting method having minimized waste.

It is another object of the invention to provide a casting method resulting in a uniform crystal structure within the material.

It is a further object of the invention to provide a casting method resulting in lower stresses and a reduced probability of cracking and/or shrinkage voids within the casting.

It is another object of the invention to provide a casting having a more uniform structure.

It is a further object of the invention to provide an apparatus and method for producing a cladding around the casting, with the cladding having better adhesion than prior claddings.

It is a another object of the invention to provide an apparatus and method for producing a multiple layer ingot product having at least two layers.

These and other objects of the invention will become more apparent through the following description and drawing.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Like reference characters denote like elements throughout the drawings.

DETAILED DESCRIPTION OF THE PREFERRED EMBODIMENTS

Figure 1:
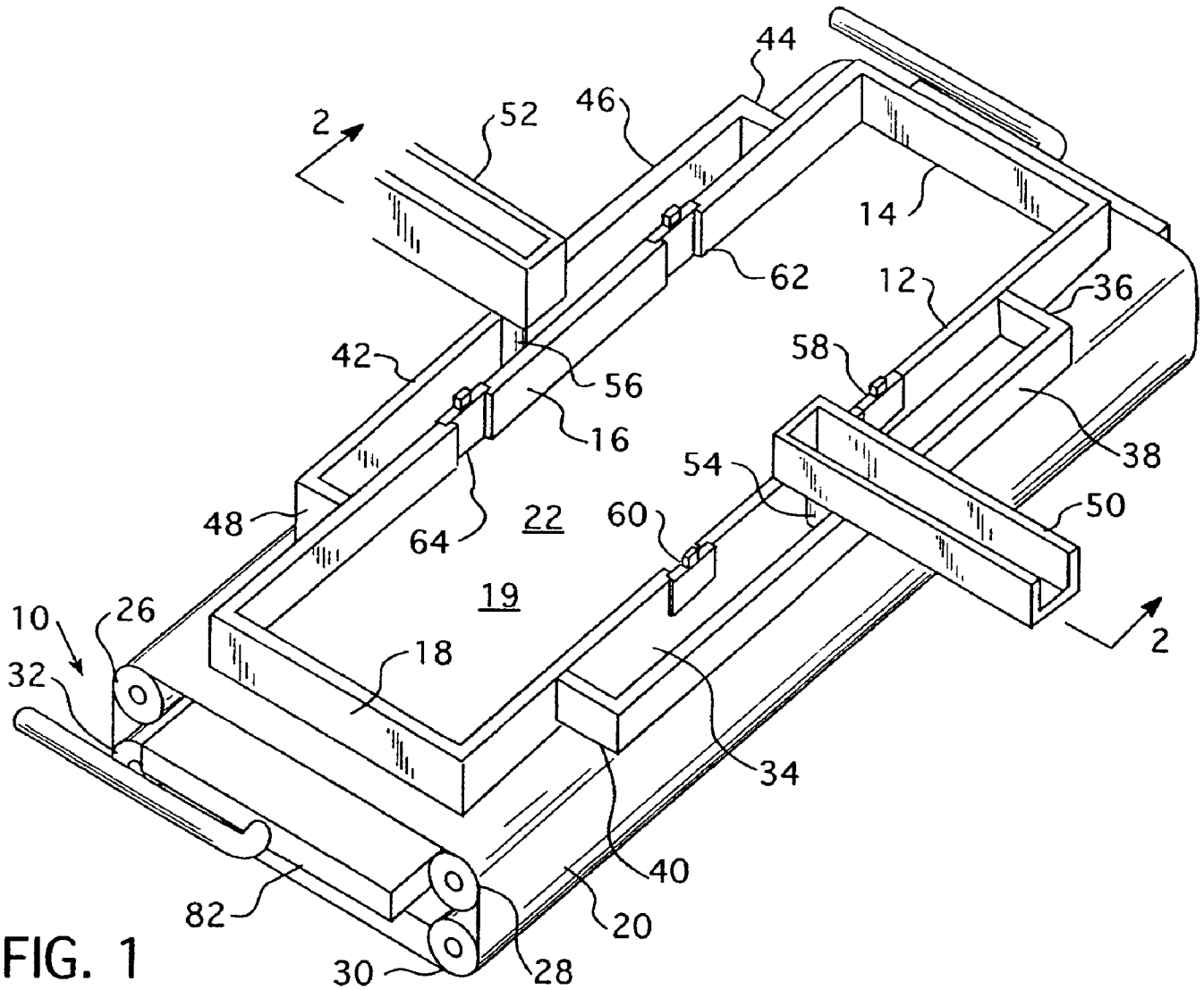
FIG. 1 is a top isometric view of a mold according to the present invention, showing the solid portion of the conveyor below the mold.

The present invention provides an apparatus and method of unidirectionally solidifying a casting, while also providing for a controlled, uniform solidification rate.

Referring to FIGS. 1-4, a mold 10 includes four sides 12, 14, 16, 18, respectively, with a mold cavity 19 defined therein. The sides 12, 14, 16, 18 are preferably insulated. A bottom 20 may be formed by a conveyor having a solid portion 22 and a mesh portion 24. The conveyor 20 is continuous, wrapping around the rollers 26, 28, 30, 32, respectively, so that either of the solid portion 22 or mesh portion 24 may selectively be placed under the sides 12, 14, 16, 18. The conveyor may be made from any rigid material having a high thermal conductivity, with examples including copper, aluminum, stainless steel, and Inconal. Note that the mesh portion 24 is a section having openings.

A molten metal feed chamber 34 defined by sides 36, 38, 40 is defined along the side 12. Likewise, a similar molten metal feed chamber 42 is defined by the sides 44, 46, 48, along side the sides 16. Some embodiments of the present invention may only have one molten metal feed chamber, and others may have multiple molten metal feed chambers. A feed trough 50, 52 extends from a molten metal furnace (not shown, and well known in the art of casting) to a location directly above each of the molten metal feed chambers, 34, 42, respectively. A spout 54 extends from the feed trough 50 to the molten metal feed chamber 34. Likewise, a spout 56 extends from the feed trough 52 to the molten metal feed chamber 42.

Figure 7:
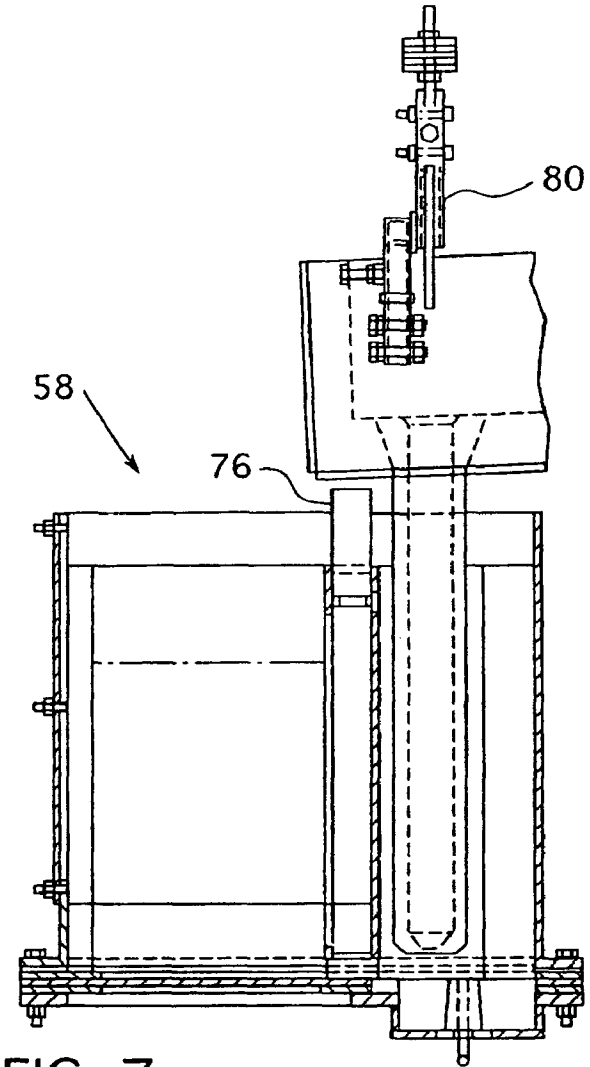
FIG. 7 is a side view of a gate according to the present invention.
Figure 5:
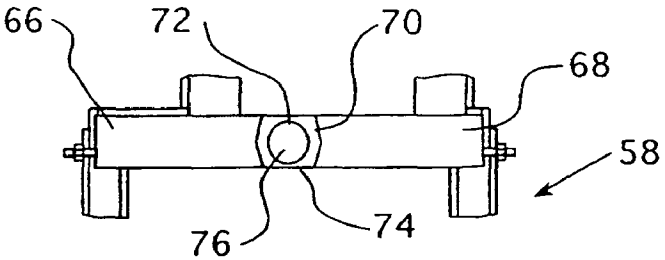
FIG. 5 is a top view of a gate according to the present invention.
Figure 6:
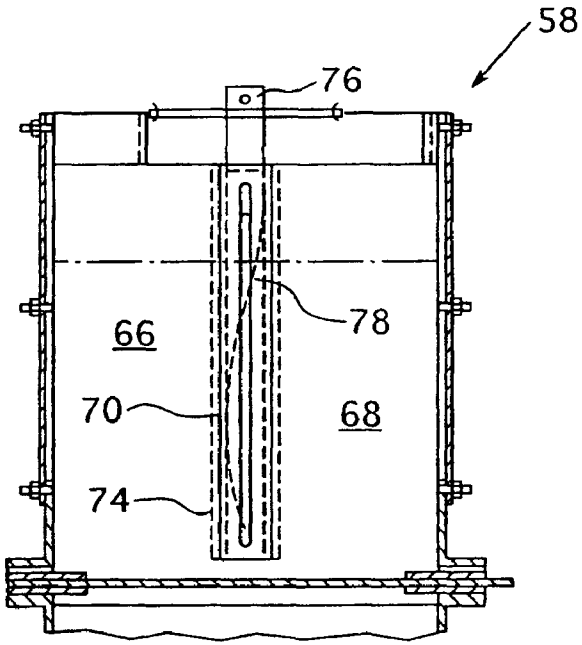
FIG. 6 is a front view of a gate according to the present invention.

The side 12 includes one or more gates 58, 60 structured to control the flow of molten metal from the feed chamber 34 to the mold cavity 19. Likewise, the side 16 includes gates 62, 64, structured to control the flow of molten metal from the feed chamber 42 into the mold cavity 19. The gates 58, 60, 62, 64 are substantially identical, and are best illustrated in FIGS. 5-7. The gate 58 includes a pair of walls 66, 68 defining a substantially cylindrical channel 70 therebetween. The channel 70 includes open sides 72, 74, on opposing sides of the walls 66, 68. A cylindrical gate member 76 is disposed within the channel 70. The cylindrical gate member 76 is substantially solid, and defines a helical slot 78 about its circumference. The channel 70, cylindrical gate member 76, and helical slot 78 are structured so that molten metal is permitted to flow through a portion of the helical slot 78 that is directly adjacent to one of the walls 66, 68, and molten metal is resisted from passing through any other portion of the gate 58. A drive mechanism 80 is operatively connected to the cylindrical gate member 76, for controlling the rotation of the cylindrical gate member 76. Appropriate drive mechanisms 80 are well known to those skilled in the art, and will therefore not be described in great detail herein. The drive mechanism 80, may, for example, include an electrical motor connected through a gearing system to the cylindrical gate member 76, with the electrical motor being controlled either through manual switching by an operator observing the casting process, or by an appropriate microprocessor.

Referring back to FIGS. 1-4, a coolant manifold 82 is disposed within the conveyor 20, and is structured to spray a coolant against the bottom surface 22, 24, of the mold cavity 19. A preferred coolant manifold 82 is structured to supply air, water, or a mixture thereof, depending upon the desired rate of cooling.

Figure 2:
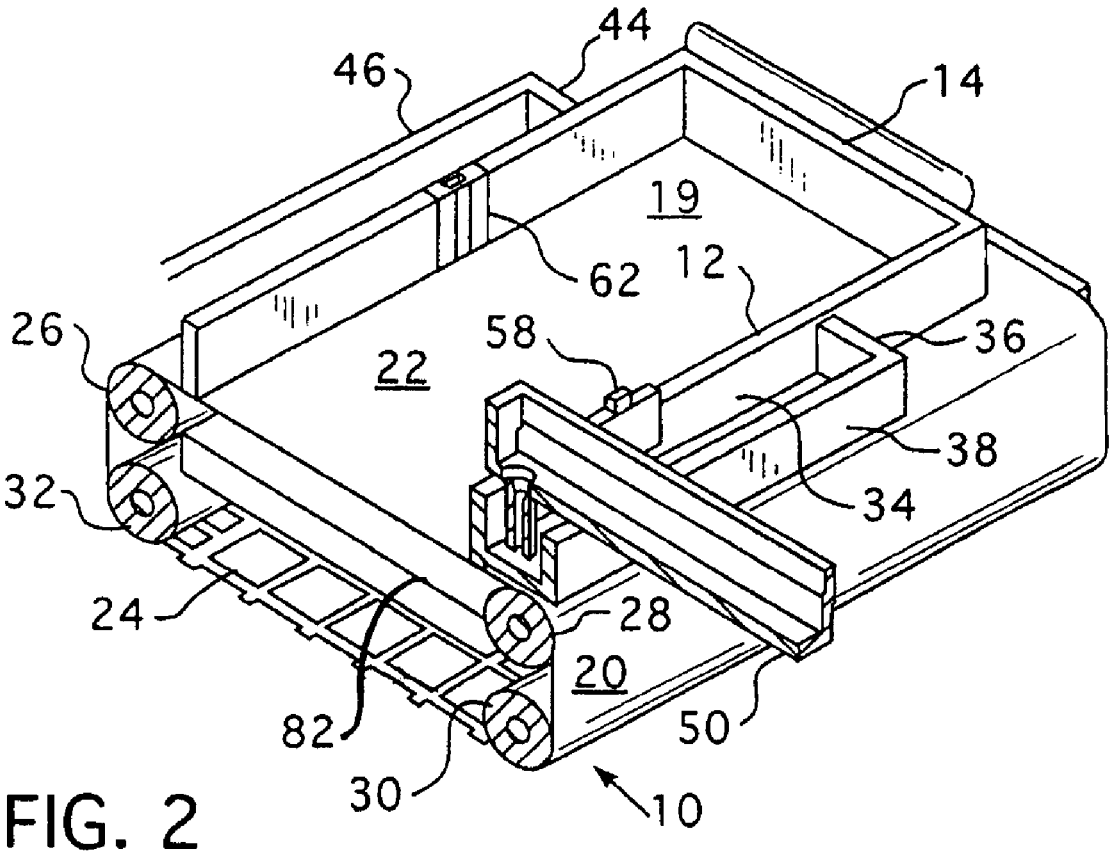
FIG. 2 is a partially sectional isometric top view of a mold according to the present invention, taken along the lines 2-2 in FIG. 1.

In use, the conveyor 20 will be in the position illustrated in FIGS. 1-2, with the solid portion 22 directly under the mold cavity 19. Molten metal will be introduced from the feed trough 50, through the spout 54, into the feed chamber 34. The gates 58, 60 will have their cylindrical gate members 76 rotated so that the lowest portion of the helical slot 78 is adjacent to the wall 66 or the wall 68, thereby permitting molten metal to enter the mold cavity 19 by flowing substantially horizontally onto the conveyor surface 22. At the same time, air will be sprayed from the coolant manifold 82 onto the underside of the surface 22. As the mold cavity 19 is filled with molten metal, the cylindrical gate members 76 will be rotated so that increasingly elevated portions of the helical slot 78 are adjacent to either of the walls 66, 68, so that, as the level of metal within the mold cavity 19 is raised, the portion of the helical slot 78 through which molten metal is permitted to pass will be raised a corresponding amount so that the flow of molten metal from the chamber 34 to the mold cavity 19 is always horizontal, and always on top of the metal that is already within the mold cavity 19. The horizontal flow of metal into the mold cavity 19 will permit the molten metal to properly find its own level, thereby insuring a substantially even thickness of molten metal within the mold cavity 19.

Figure 3:
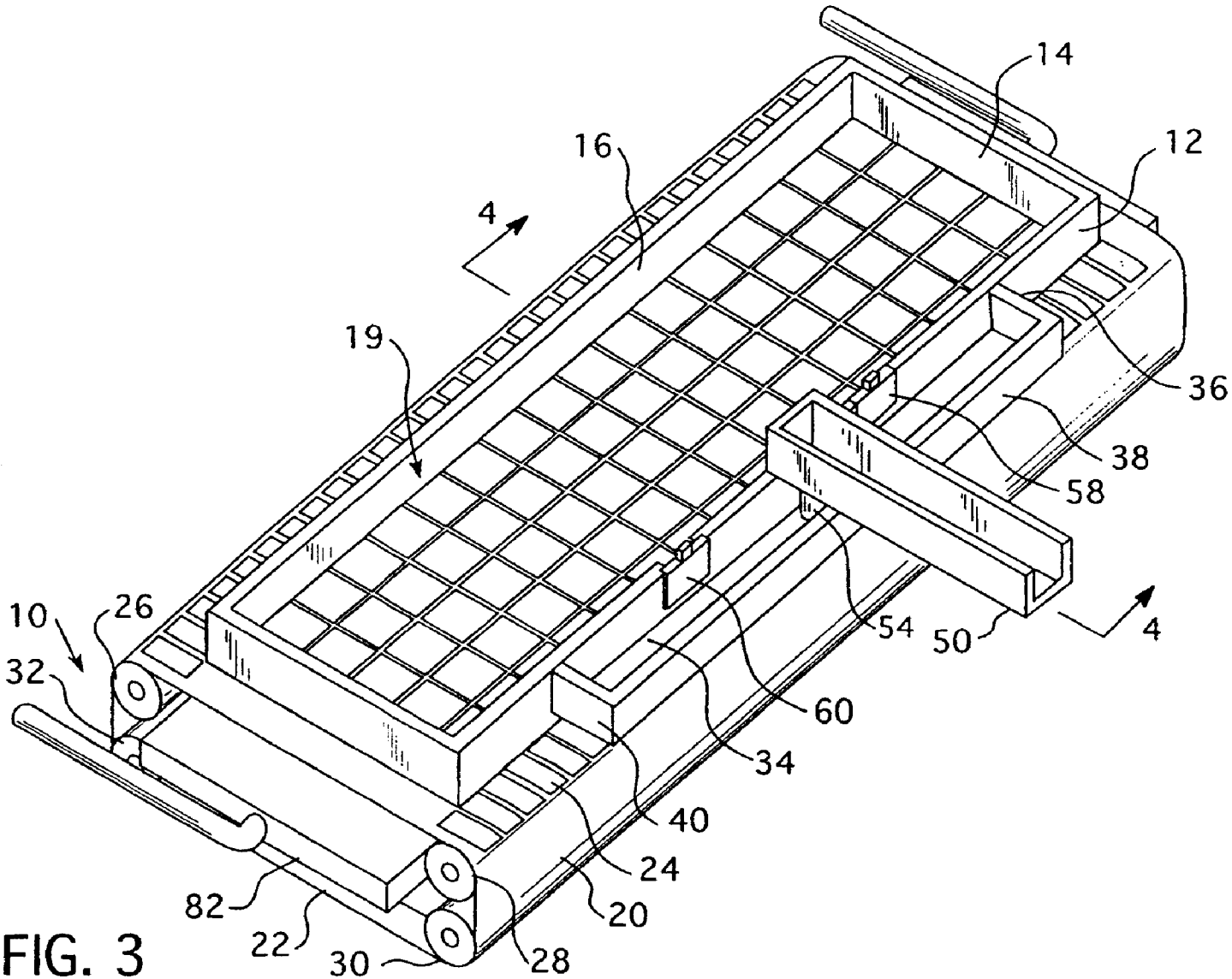
FIG. 3 is an isometric top view of a mold according to the present invention, showing the mesh portion of the conveyor below the mold.
Figure 4:
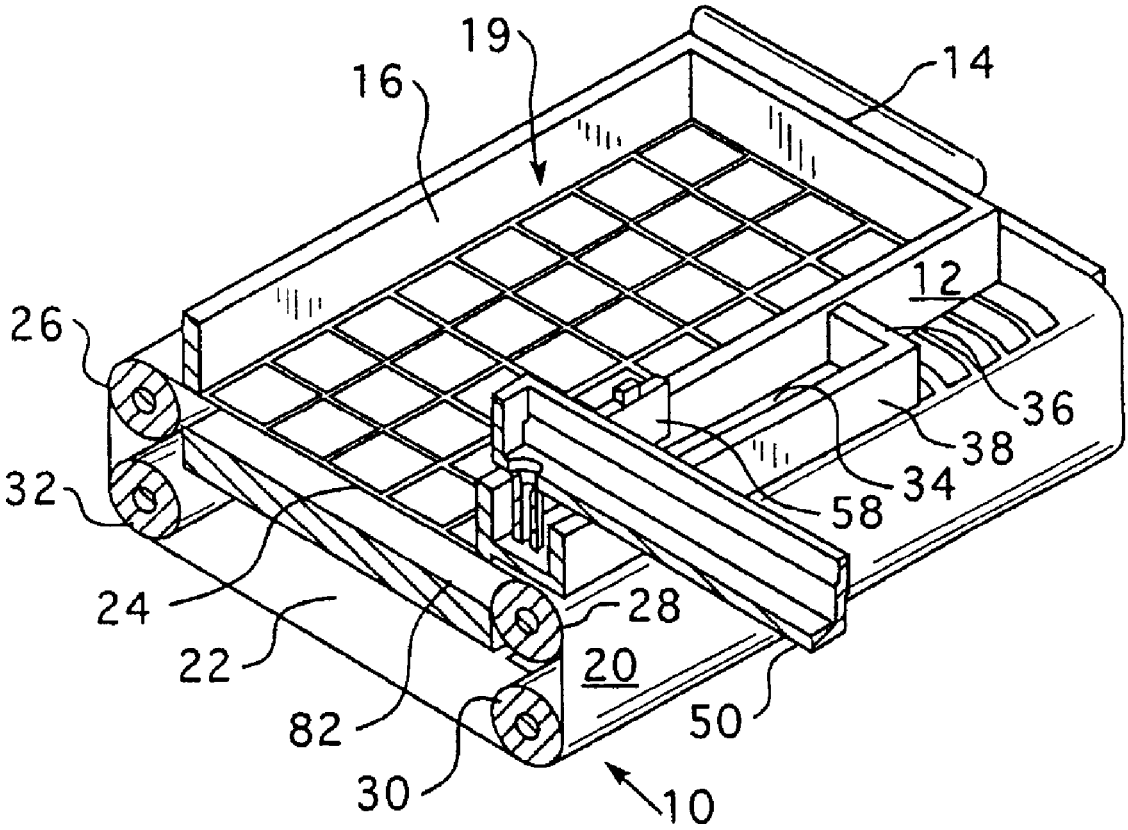
FIG. 4 is a partially sectional isometric top view of a mold according to the present invention, taken along the lines 4-4 in FIG. 3.

As additional metal is added to the mold cavity 19, the cooling rate for the metal within the mold cavity 19 will slow. To maintain a substantially constant cooling rate, the mixture of coolant from the coolant manifold 82 will be changed from air to an air-water mist containing increasing quantities of water, and eventually to all water. Additionally, as the metal at the bottom portion of the mold cavity 19 solidifies, the conveyor 20 will be advanced so that the mesh 24 instead of the solid portion 22 forms the bottom of the mold 10, thereby permitting coolant to directly contact the solidified metal, as shown in FIGS. 3-4. Additionally, the rate of metal addition into the mold cavity 19 may be slowed by controlling either the rotation of the cylindrical gate members 76 of the gates 58, 60, and/or the rate of introduction of metal into the feed chamber 34 from the feed trough 50. Typically, the cooling rate will remain between about 0.5° F./sec. to about 3° F./sec., with the cooling rate typically decreasing from 3° F./sec. at the beginning of casting to about 0.5° F./sec. towards the completion of casting. Likewise, the rate at which molten metal is introduced into the mold cavity 19 will typically be slowed from an initial rate of about 4 in./min. to a final rate of 0.5 in./min. as casting progresses.

If desired, a second alloy may be introduced into the feed chamber 42 from the feed trough 52, and through the spout 56. This second alloy may be used to form a cladding around the first alloy. For example, the cladding may be a corrosion resistant layer. One example of a cladding may be formed by first introducing an alloy from the feed chamber 42, through the gates 62, 64, into the mold cavity 19 by rotating the cylindrical gate members 76 of the gates 62, 64, so that metal flows from the bottom portion of the helical channel 78 within these gates into the mold cavity 19, and then closing the gates 62, 64. The cylindrical gate member 76 of the gates 58, 60 are then rotated to permit the flow of molten metal from the feed chamber 34 into the mold cavity 19 at increasingly elevated portions of the helical slot 78, until the mold cavity 19 is filled almost all of the way to the top, at which point the gates 58, 60 are closed. The cylindrical gate members 76 of the gates 62, 64 are then rotated to permit the flow of metal from the feed chamber 42 into the mold cavity 19 at the highest portion of the slots 78 within the cylindrical gate members 76 of the gates 62, 64, thereby permitting this molten metal to flow to the top of the metal already in the mold. The resulting substrate formed from the alloy within the feed chamber 34 will have a cladding on the top and bottom made from the alloy within the feed chamber 42.

To ensure proper bonding at the interface of any of two successive layer that following procedure must be followed: The temperature of the surface of the base layer after introduction of the new subsequent layer that is a different composition from the base layer must be less than the liquidus temperature ($T_{liq}$) and greater than eutectic temperature ($T_{eut}$) −50° C. where the $T_{liq}$ is the liquidus temperature of the base layer and $T_{eut}$ is the eutectic temperature of the base layer. This procedure is not limited to just cladding. This procedure enable the casting a multiple alloys sequentially to create a multiple layer ingot product.

Figure 8:
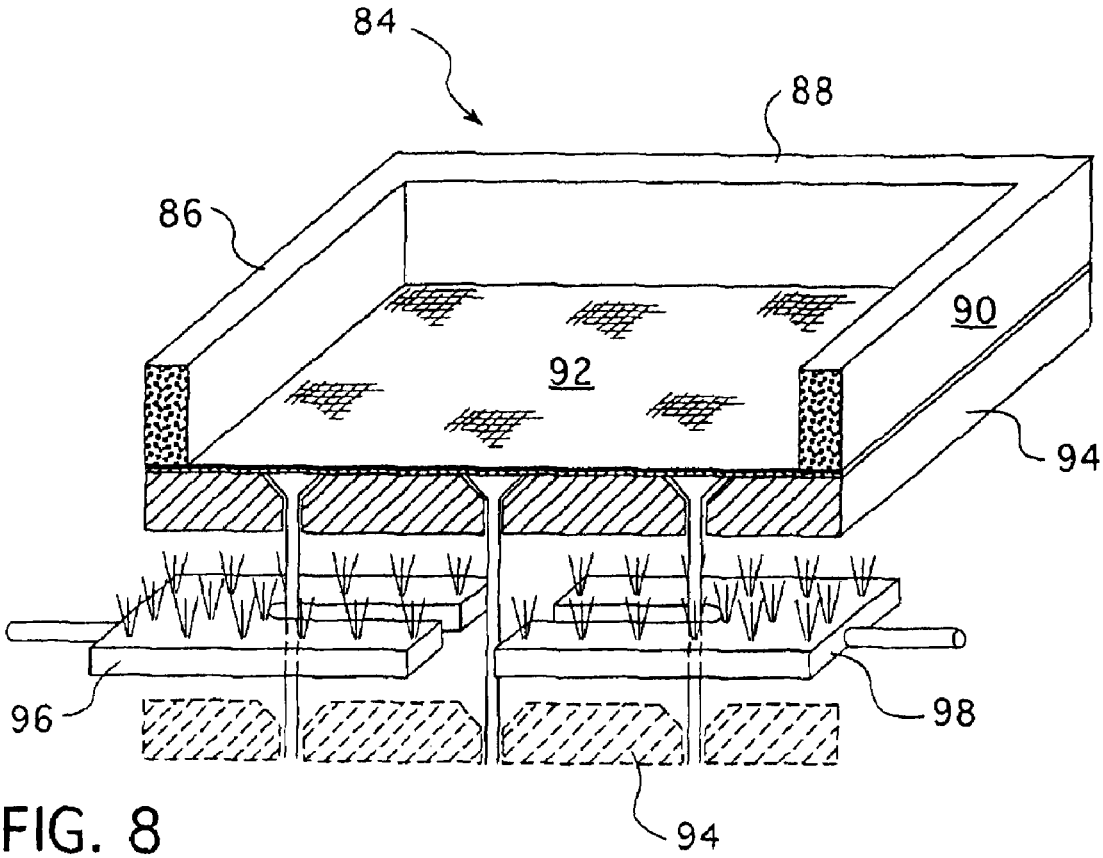
FIG. 8 is a side isometric, partially cutaway view of another embodiment of a mold according to the present invention.

Another embodiment of a mold 84 is illustrated in FIG. 8. The mold 84 includes four sides, with three sides 86, 88, 90 illustrated. The sides 86, 88, 90, and the fourth substantially identical but not shown side may be insulated. The bottom of the mold 84 is formed by a cloth 92, which may be made of the same material as the bottom conveyor 20 of the previous embodiment 10. A bottom substrate 94 is structured to move between an upper position illustrated in solid lines in FIG. 8, wherein it supports the cloth 92, and a lower position, illustrated in phantom in FIG. 8, wherein the substrate is removed from the cloth 92 a sufficient distance so that the spray boxes 96, 98 may be positioned therebetween. The spray boxes 96, 98 are structured to be moved from a position below the cloth 92 to a position wherein movement of the substrate 94 between its upper and lower position is permitted. The spray boxes 96, 98 will therefore supply air, water, or a mixture of both, or possibly other coolants, to either the bottom of the substrate 94 or the bottom of the cloth 92, depending upon whether the substrate 94 is above or below the spray boxes 96, 98.

In use, the substrate 94 will be in its upper position, supporting the cloth 92. Molten metal will be introduced into the mold 84, with air being applied to the bottom of the substrate 94 to provide cooling. As the mold 84 is filled with molten motel, and the molten metal on the bottom solidifies, the spray boxes 96, 98 will be briefly withdrawn from their position under the substrate 94, thereby permitting the substrate 94 to be removed from its position under the cloth 92. The spray boxes 96, 98 will then be placed back underneath the cloth 92, so that they may apply air, an air/water mixture, or water to the bottom of the cloth 92, with increasing amounts of water being applied to the bottom of the cloth 92 as casting progresses.

Figure 10:
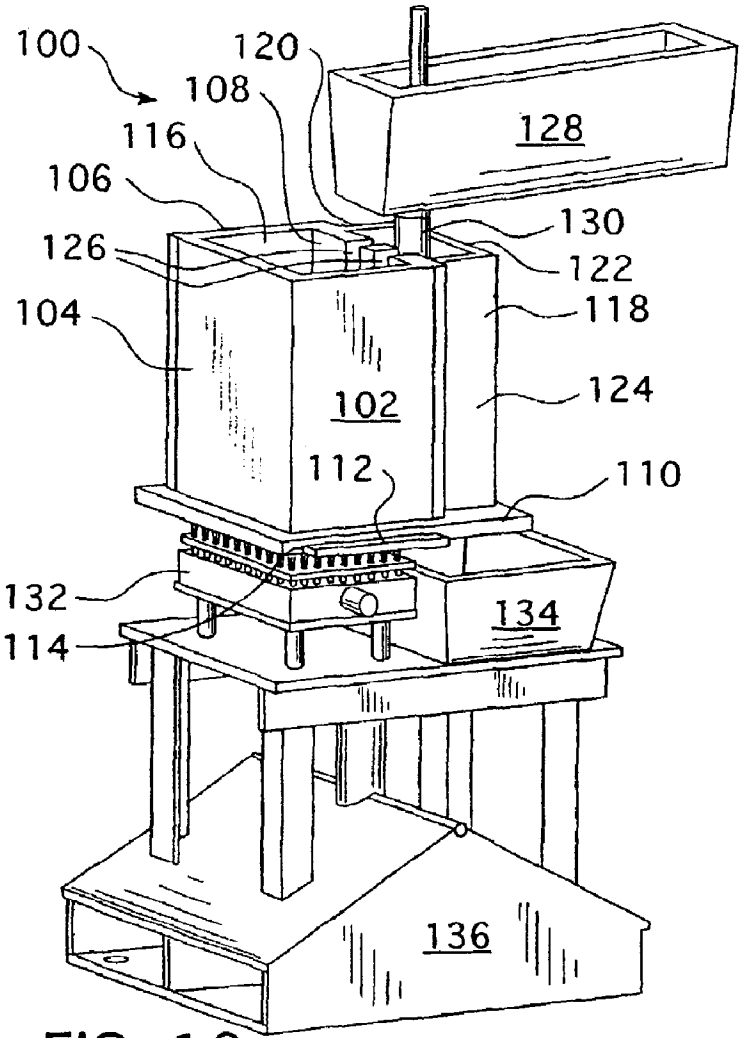
FIG. 10 is a side isometric view of the mold according to FIG. 9.
Figure 9:
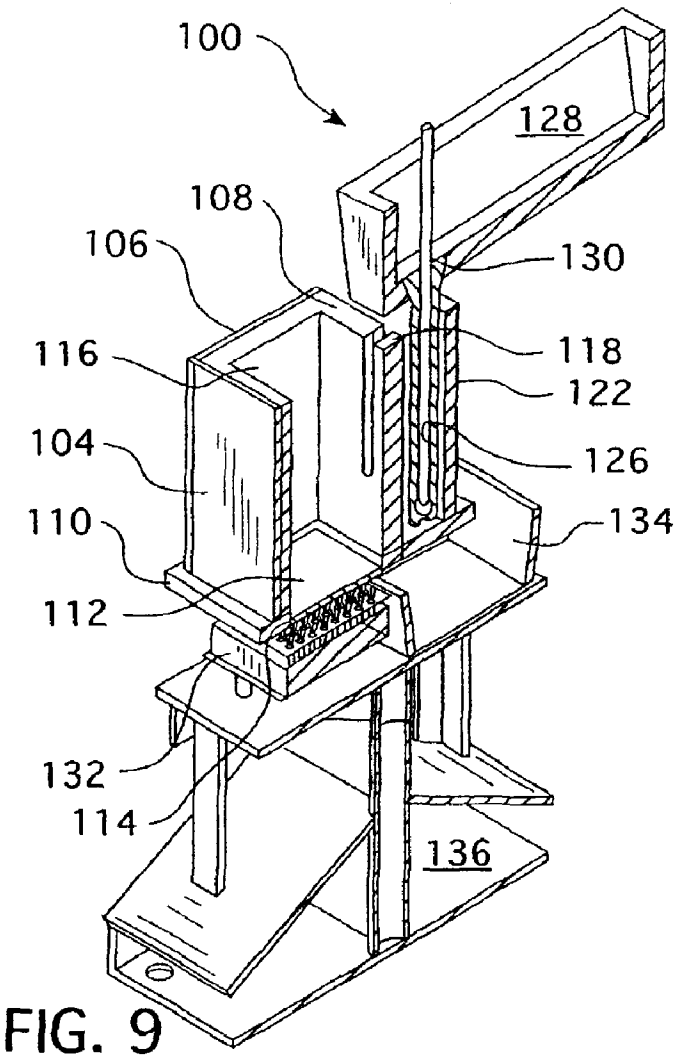
FIG. 9 is a cutaway side isometric view of another alternative embodiment of a mold according to the present invention.

FIGS. 9 and 10 illustrate yet another embodiment of a mold 100 that may be used for a method of the present invention. The mold 100 includes side walls 102, 104, 106, and 108, which may be insulated. The bottom includes a fixed floor plate 110 defining an opening below the walls 102, 104, 106, 108, wherein a removable floorplate 112 may be inserted. The removable floorplate 112 may be made from a material such as copper. The fixed floorplate 110 may in some embodiments define a slot 114 structured to receive the edges of the removable floorplate 112, thereby supporting the removable floorplate 112. The walls 102, 104, 106, 108, and the removable floorplate 112, define a mold cavity 116 therein.

A molten metal feed chamber 118 is defined by the walls 120, 122, and 124 along with the wall 108 and fixed floorplate 110. A gate 126 is defined within the wall 108, and in the illustrated examples formed by a pair of slots defined within the wall 108. A feed trough 128 extends from a molten metal furnace to a location directly above the molten metal feed chamber 118. A spout 130 extends from the feed trough 128 to the molten metal feed chamber 118.

A coolant manifold 132 is disposed below the removable floorplate 112. The coolant manifold 132 is preferably configured to selectively spray air, water, or a mixture of air and water against the removable floorplate 112. The illustrated embodiment further includes a catch basin 134 disposed below the feed chamber 118. The entire mold 100 is supported on the base 136.

In use, the removable floorplate 112 will be contained within the slot 114. Molten metal will be introduced from the feed trough 128 into the feed chamber 118, until the level of molten metal within the feed chamber 118 reaches the bottom of the slots 126. The slots 126, combined with an appropriately selected feed rate into the feed chamber 118, will ensure that the feed rate of molten metal into the mold cavity 116 is controlled. As the level of molten metal within the mold cavity 116 rises, the feed rate of molten metal into the feed chamber 118 may be adjusted so that molten metal is flowing out of the slot 126 directly on top of the molten metal within the mold cavity 116, thereby ensuring a substantially horizontal flow of molten metal into the mold cavity 116. Coolant will be sprayed against the removable floorplate 112 through the coolant manifold 132, beginning with air, and then switching to an air/water mixture, and finally all water. As molten metal within the bottom of the mold cavity 116 solidifies, the removable floorplate 112 may be removed, thereby permitting coolant to directly contact the underside of the ingot within the mold cavity 116.

In one example of a casting process according to the present invention, 7085 aluminum alloy was cast into a 9"×13"×7" ingot using a mold 100 as shown in FIGS. 9-10. The initial metal temperature was 1,280° F. The removable floorplate 112 was made from a 0.5" thick stainless steel plate. Thermocouples were placed along the center line of the ingot at 0.25 inch, 0.75 inch, 2 inches and 4 inches from the removable floorplate 112. The mold cavity 116 was initially filled at a rate of 2 inches every 30 seconds, with a fill rate slowing as casting progressed. The initial water flow rate was 0.25 gallons per minute, in the form of a combined air/water mixture. The removable floorplate 112 was removed when a thermocouple located 0.25 inch from the removable floorplate 112 read 1,080° F. At this point, the flow rate of water was increased to 1 gallon per minute.

Figure 11:
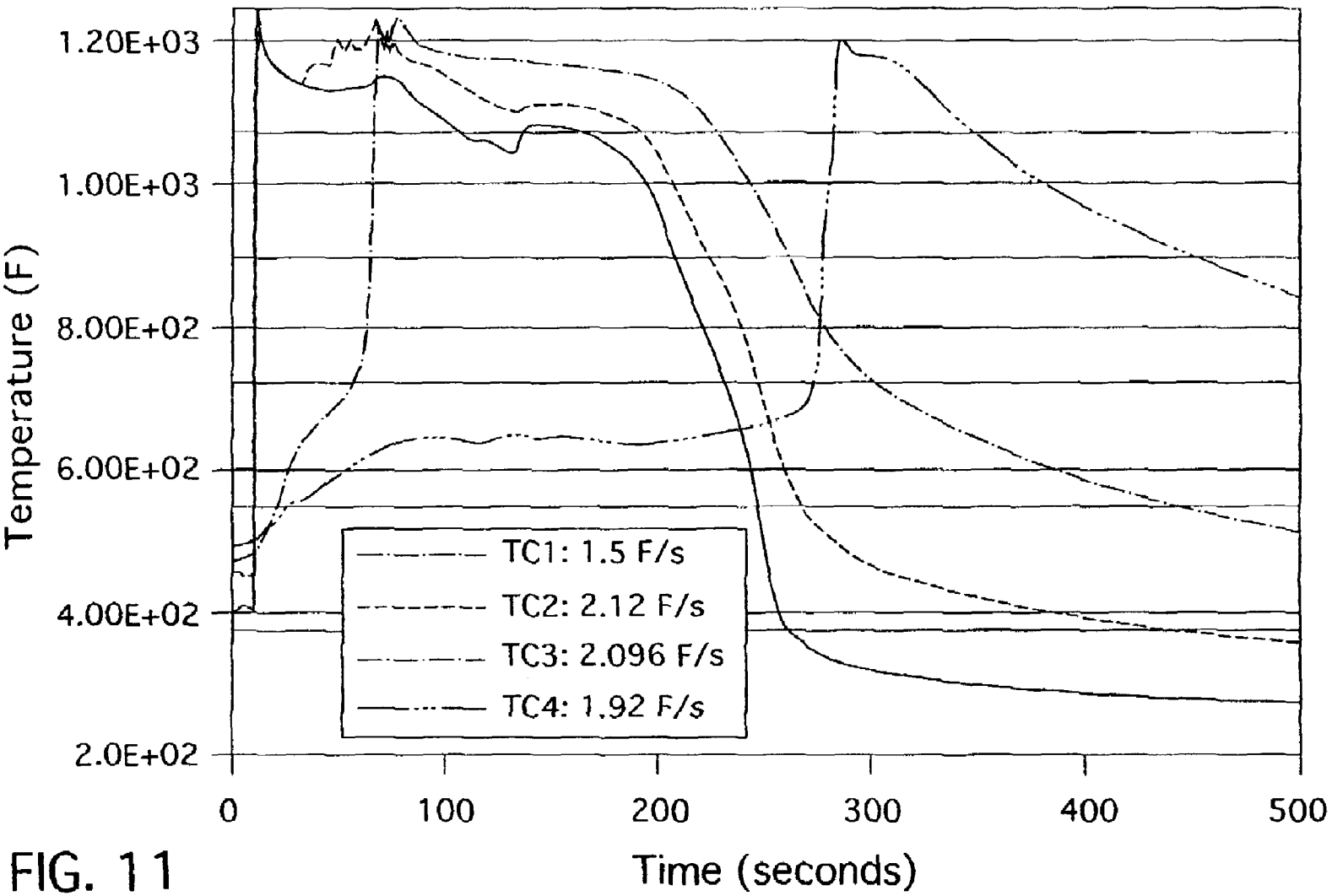
FIG. 11 is a graph showing temperature of the casting with respect to time during an example solidification process.

FIG. 11 shows the cooling rate at each of the four thermocouples. As can be seen from this figure, the cooling rate ranged from 1.5 to 2.12° F./sec., a substantially uniform cooling rate.

Figure 12:
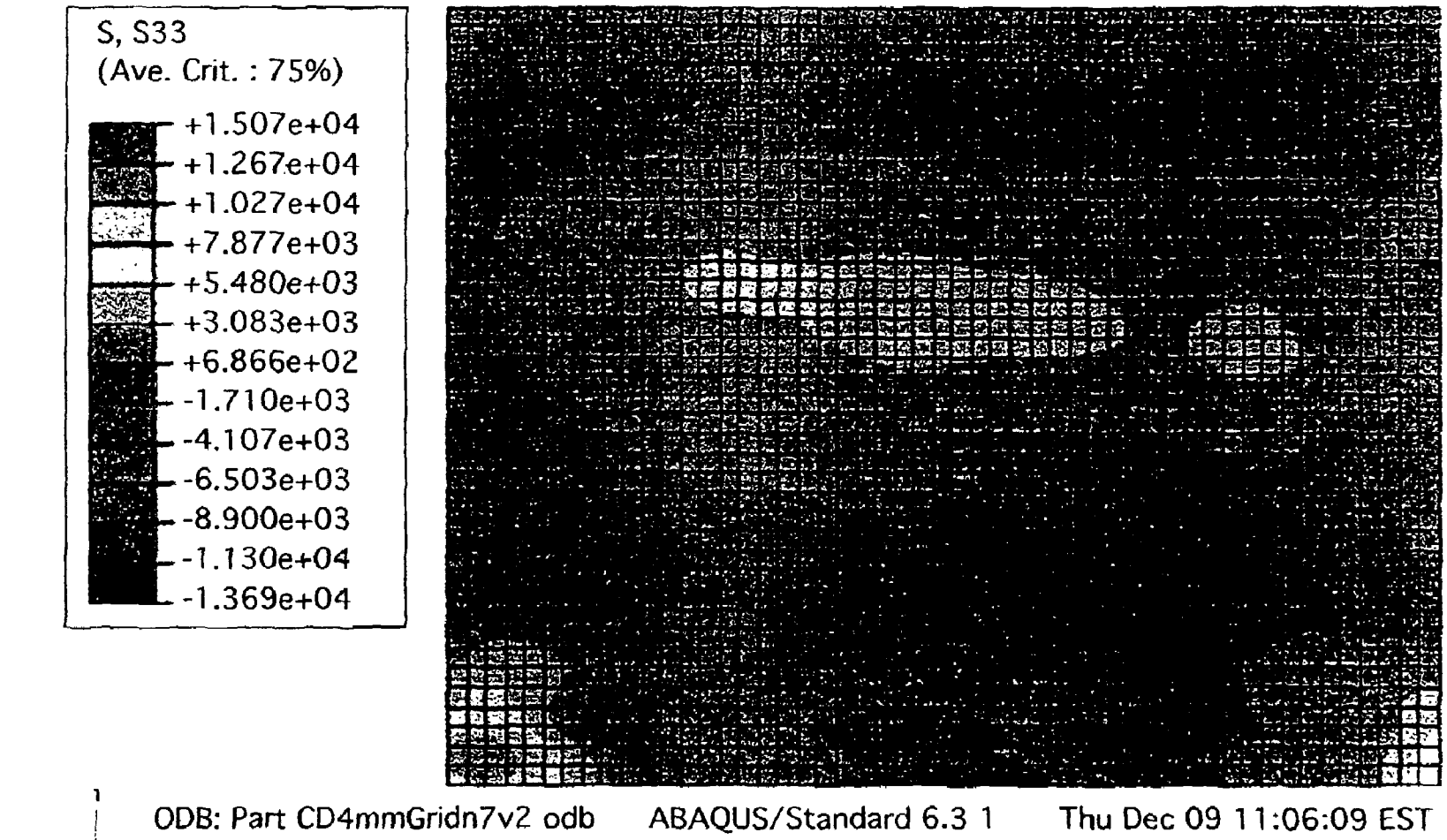
FIG. 12 is a graph showing cross-sectional stress distribution across an ingot made according to the present invention.

FIG. 12 is a graph showing residual stresses throughout a cross-section of the ingot. This data was collected by cutting the ingot in half in the 9" direction, and then measuring the resulting surface deformation as the stresses within the material relaxed. With the exception of one tensile stress in the lower left-hand corner of FIG. 12, and one compressive stress in the lower center portion of FIG. 12, the magnitude of the stresses throughout the ingot is 0.6 to 3 ksi. The larger compressive stress at the center of the ingot's bottom is of little concern, because compressive stress generally does not result in cracking. The high compressive stresses at this location and high tensile stresses in the lower left corner are probably the result of molten metal first impinging on the substrate at these locations, resulting in the formation of cold shots and possibly other defects. The highest tensile stress was $+6e^{+02}$ PSI.

Figure 13:
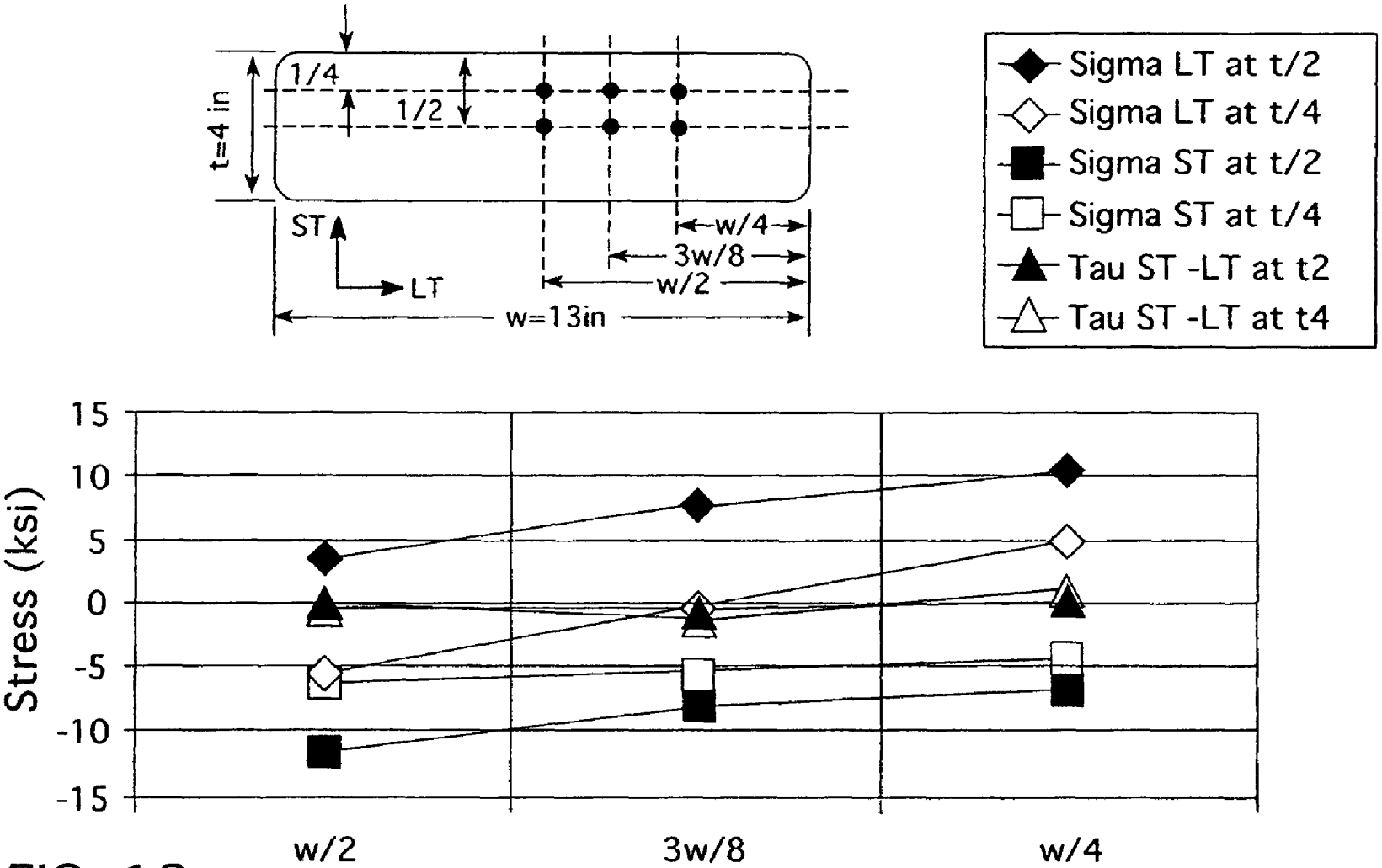
FIG. 13 is a graph showing stress at various locations within an ingot cast using prior art methods.

Referring to FIG. 13, the residual stresses across the cross-section of a 4 inch by 13 inch 7085 aluminum alloy DC cast ingot are illustrated. As the figure shows, the residual stresses resulting from presently performed DC casting can be as high as 10 ksi. However, the stresses in this ingot were likely even higher, because the ingot already had a longitudinal crack when the stress was measured, which would have relaxed these stresses, As used in the figure, sigma refers to tensile or compressive stress, tau refers to sheer stress, LT refers to the direction substantially parallel to the length, and ST refers to a direction substantially parallel to the thickness.

The application of coolant to the bottom of the mold, along with, in some preferred embodiments, the insulation on the sides 12, 14, 16, 18, results in directional solidification of the casting from the bottom to the top of the mold cavity 19. Preferably, the rate of introduction of molten metal into the mold cavity 19, combined with the cooling rate, will be controlled to maintain about 0.1 inch (2.54 mm.) to about 1 inch (25.4 mm.) of molten metal within the mold cavity 19 at any given time. In some embodiments, the mushy zone between the molten metal and solidified metal may also be kept at a substantially uniform thickness. As a result of this directional solidification, uniform temperature, and thin sections of molten metal and mushy zone, macrosegregation is substantially reduced or eliminated.

Figure 14:
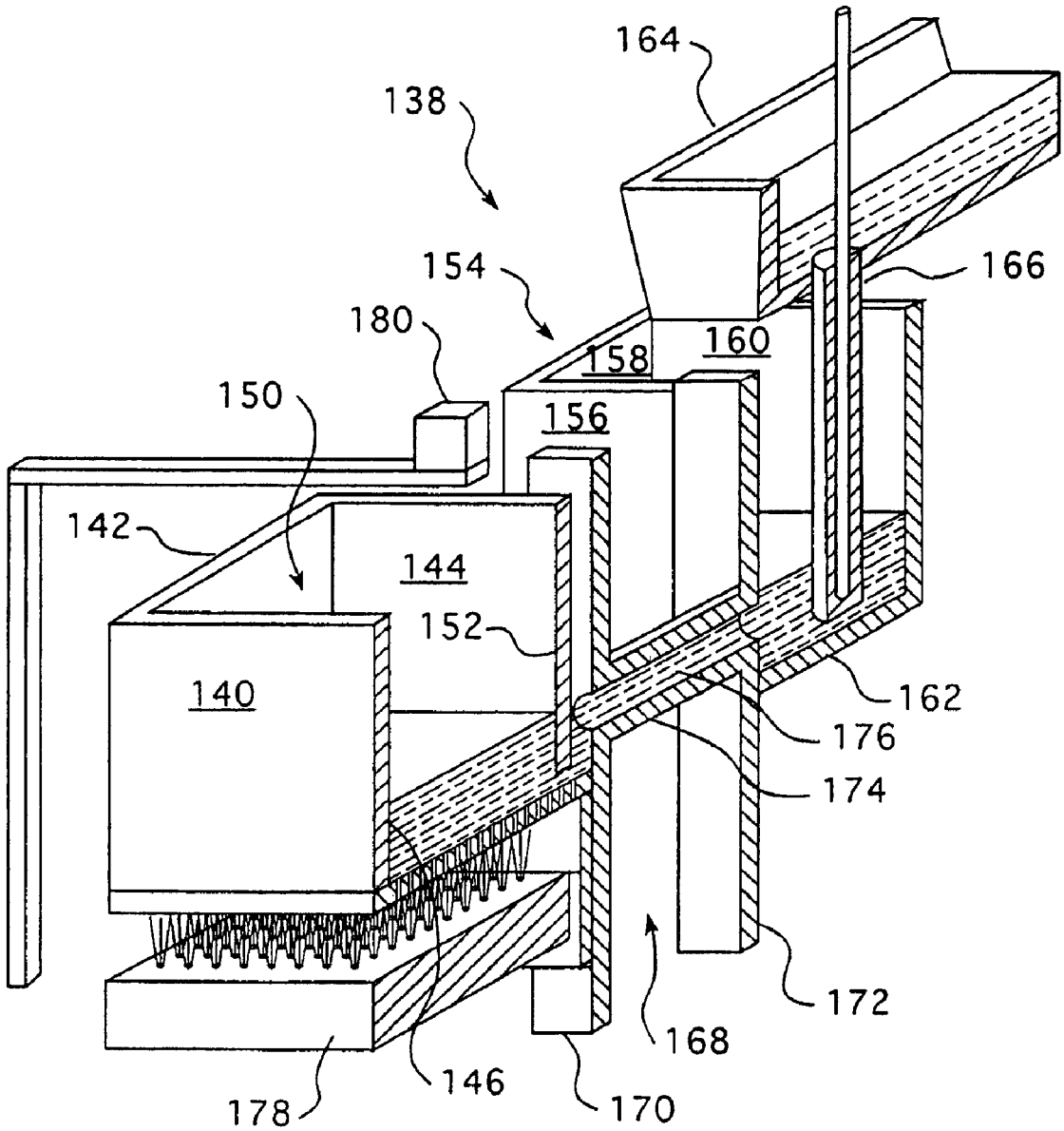
FIG. 14 is a cutaway isometric view of yet another embodiment of a mold and transfer chamber according to the present invention.
Figure 15:
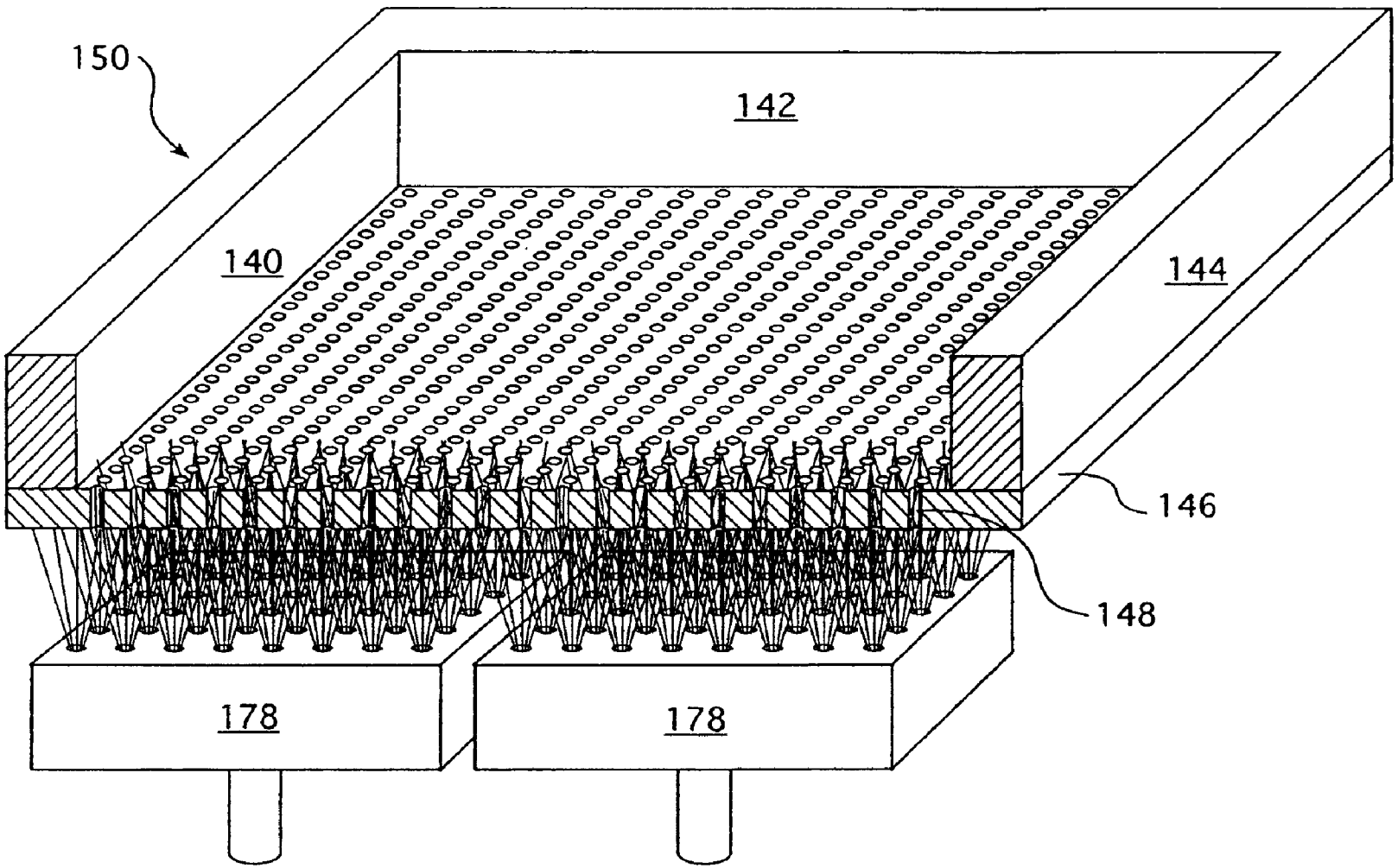
FIG. 15 is a cutaway front isometric view of a mold cavity for a mold according to the present invention.

Referring to FIG. 14, another mold assembly 138 is illustrated. The mold assembly 138 includes 140, 142, 144, and a fourth side that is not illustrated in the cutaway drawing, opposite the side 142. All four walls 140, 142, 144, and the unillustrated wall may be insulated, with a preferred insulating material being graphite. The mold 138 further includes a bottom 146, which preferably includes a plurality of apertures 148 (best illustrated in FIG. 15) having a diameter sufficiently large to permit the passage of typical coolants such as air or water, while also being sufficiently small to resist the passage of molten metal there through. A preferred diameter for the apertures 148 is about 1/64 inch to about one inch. The mold's cavity 150 is defined by the walls 140, 142, 144, the fourth wall, and the bottom 146. Wall 144 defines a slot therein, the edge 152 of the slot visible in FIG. 14.

The molten metal feed chamber 154 is defined by the walls 156, 158, 160, a fourth unillustrated wall, and the bottom 162. A feed trough 164 extends from a molten metal furnace to a location directly above the molten metal feed chamber 154. A spout 166 extends from the feed trough 164 to the molten metal feed chamber 154.

A gate 168 is an H shaped structure, having a pair of vertical slot closure members 170, 172, connected by a horizontal member 174 defining a channel 176 therethrough. Slot closure member 170 is structured to substantially close a slot in the wall 144 of the mold cavity 150, while the closure member 172 is structured to substantially close the slot defined within the wall 156 of the molten metal feed chamber 154. The gate 168 is structured to slide between a lower position wherein the channel 176 is located adjacent to the bottom 146 of the mold cavity 150, and an upper position corresponding to the top of the mold cavity 150. The slot closure members 170, 172 are structured to resist the flow of molten metal through the slots defined in the walls 144, 156 at any point except through the channel 176, regardless of the position of the gate 168.

A coolant manifold 178 is disposed below the bottom 146. The coolant manifold 178 preferably configured to selectively spray air, water, or a mixture of air and water against the bottom 146.

A laser sensor 180 be disposed above the mold cavity 150, and is preferably structured to monitor the level of molten metal within the mold cavity 150.

In use, molten metal will be introduced through the feed trough 164 into the feed chamber 154. Molten metal may then flow through the channel 176 into the mold cavity 150. As the level of molten metal within the mold cavity 150 arises, the gate 168 will be raised so that molten metal always flows horizontally from the feed chamber 154 directly on top of the molten metal already in the mold chamber 150. The feed rate of molten metal into the mold chamber 150 may be slowed as cooling progresses to control the cooling rate. Additionally, coolant flowing from the coolant manifold 178 will change from air to an air/water mixture to all water as casting progresses to control the cooling rate of the molten metal within the feed chamber 150. Because coolant may impinge directly on the metal within the feed chamber 150, it is unnecessary to remove the bottom 146 during the casting process.

Figure 16:
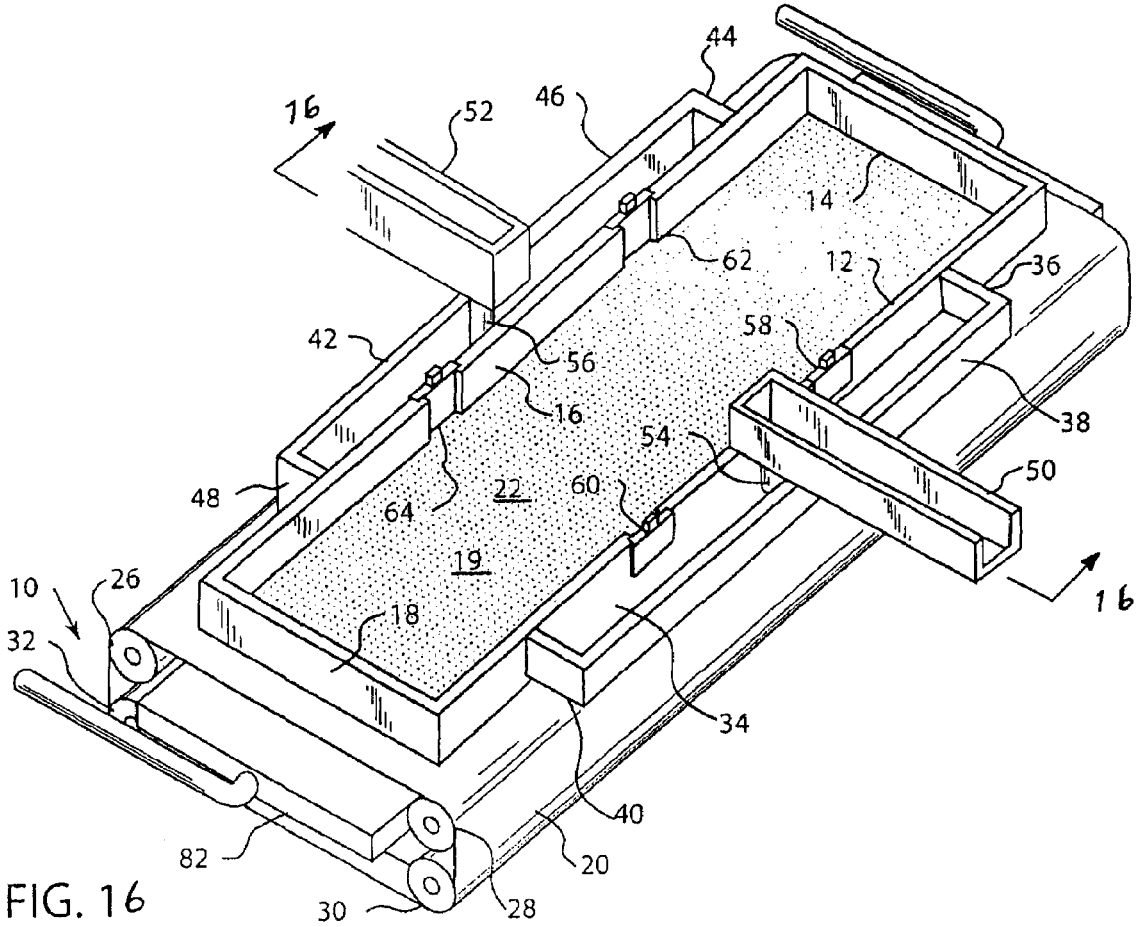
FIG. 16 is a top isometric view of a mold according to another embodiment of the present invention, showing the perforated portion of the conveyor below the mold.

FIG. 16 shows a top isometric view of a mold according to another embodiment of the present invention, showing the perforated portion of the conveyor below the mold. All elements in FIG. 16 are present and identified by the same reference numerals as shown in FIG. 1. Mold 10 includes four sides 12, 14, 16, 18, respectively, with a mold cavity 19 defined therein. The sides 12, 14, 16, 18 are preferably insulated. A bottom 20 may be formed by a conveyor having a perforated portion 22 and a mesh portion 24. The conveyor 20 is continuous, wrapping around the rollers 26, 28, 30, 32, respectively, so that either of the perforated portion 22 or mesh portion 24 may selectively be placed under the sides 12, 14, 16, 18. The conveyor may be made from any rigid material having a high thermal conductivity, with examples including copper, aluminum, stainless steel, and Inconal.

Figure 17:
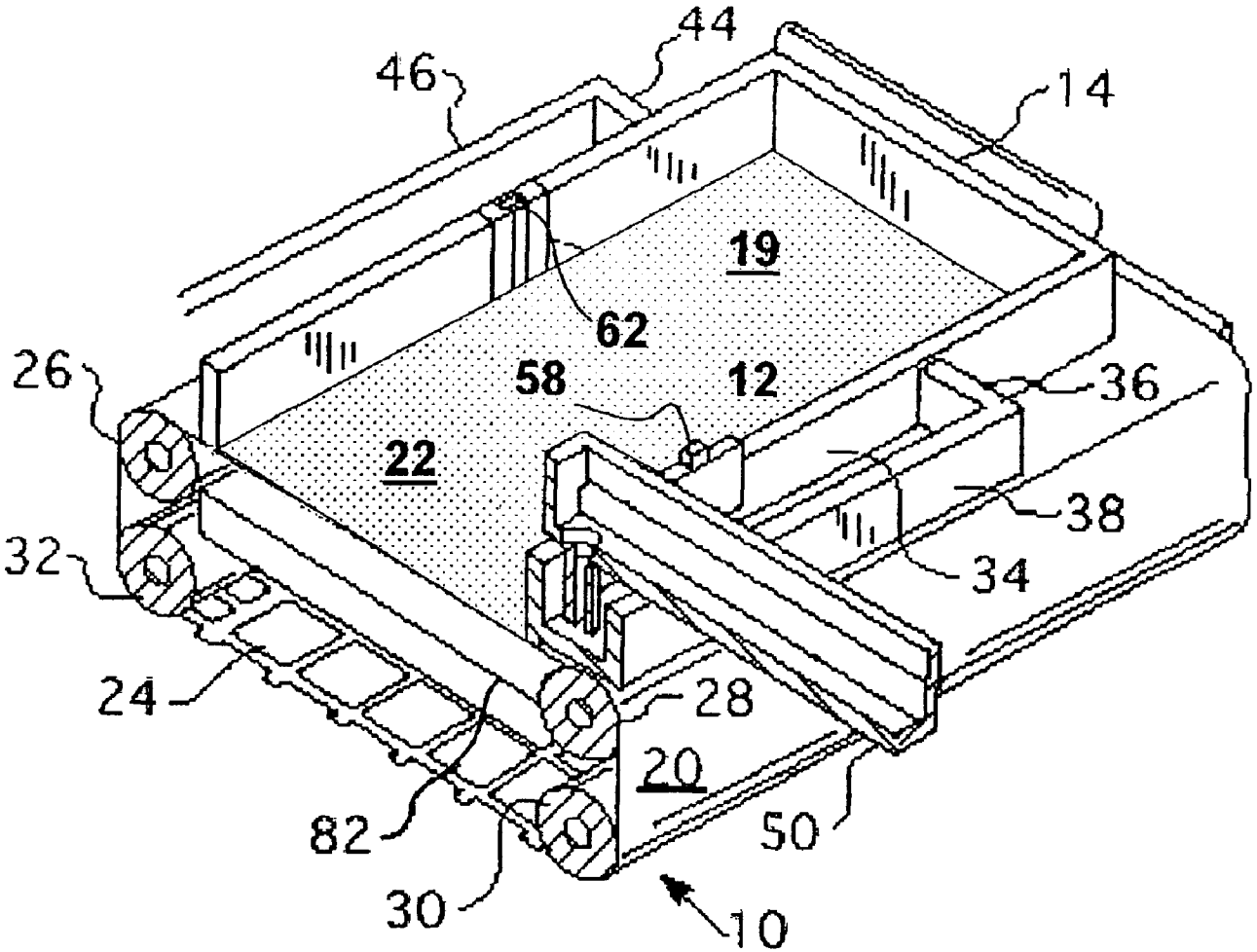
FIG. 17 is a partially sectional isometric top view of the mold shown in FIG. 16, taken along the lines 16-16 in FIG. 16.

FIG. 17 shows a partially sectional isometric top view of the mold shown in FIG. 16, taken along the lines 16-16 in FIG. 16.

Figure 18:
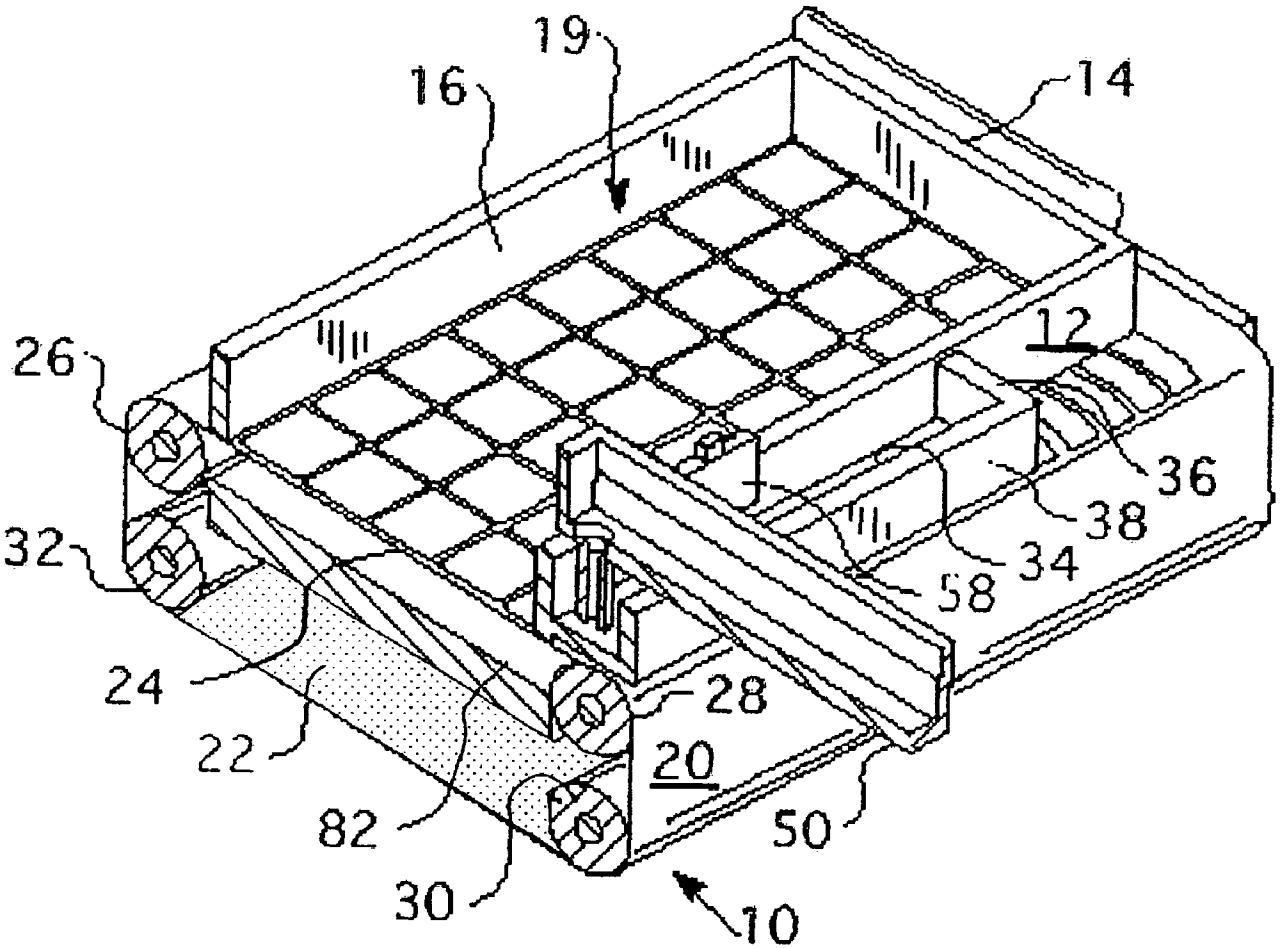
FIG. 18 is a partially sectional isometric top view of the mold shown in FIG. 16, where the mesh portion of the conveyor is below the mold.

FIG. 18 shows a partially sectional isometric top view of the mold shown in FIG. 16, where the mesh portion of the conveyor is below the mold.

FIGS. 16, 17 and 18 are similar to FIGS. 1, 2 and 4. The main difference between the two sets of Figures is that FIGS. 1, 2 and 4 shows a solid and a mesh portion of the conveyor below the mold, respectively, whereas FIGS. 16, 17 and 18 shows a perforated and a mesh portion of the conveyor below the mold, respectively.

Figure 19A:
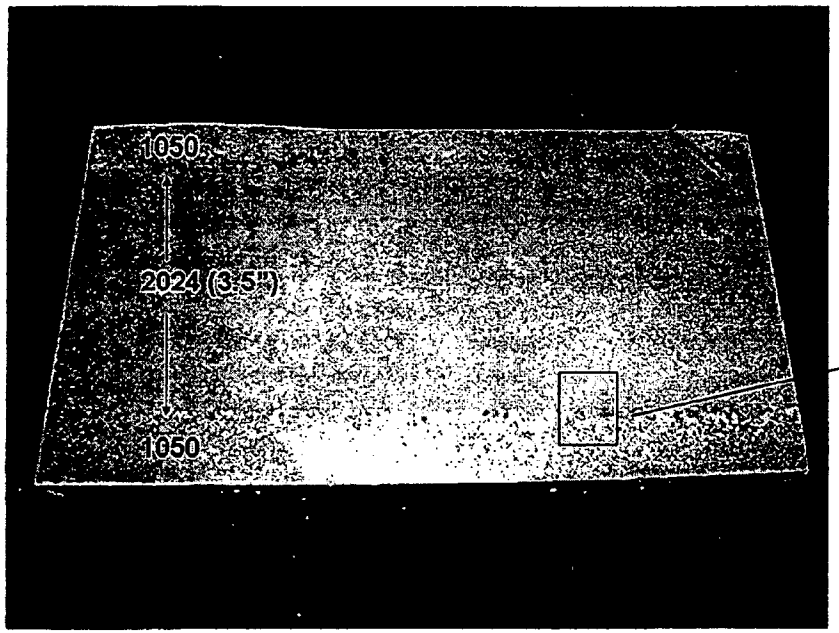
FIG. 19A is a perspective view of a three layer multiple ingot for a skin sheet product having a 2024 alloy sandwiched between two layers of 1050 alloy.

FIG. 19A shows a three layer multiple layer ingot for a skin sheet product having a 2024 alloy sandwiched between two layers of 1050 alloy. Here, the 2024 alloy has a liquidus temperature 1180° F. and eutectic temperature of 935° F. and the 1050 alloy has a liquidus temperature 1198° F. and eutectic temperature of 1189° F. In this example, upon casting a 0.75" thick layer of the first cladding layer of alloy 1050, a 3.5" thick layer of the core alloy 2024 was poured at a controlled rate of 0.7 ipm ensuring that the interface temperature rose to a value between 1148° F. and 1189° F. After casting the cores material, a 0.75" thick second cladding layer of alloy was poured ensuring that the interface temperature rose to a value between 885° F. and 1180° F.

Figure 19B:
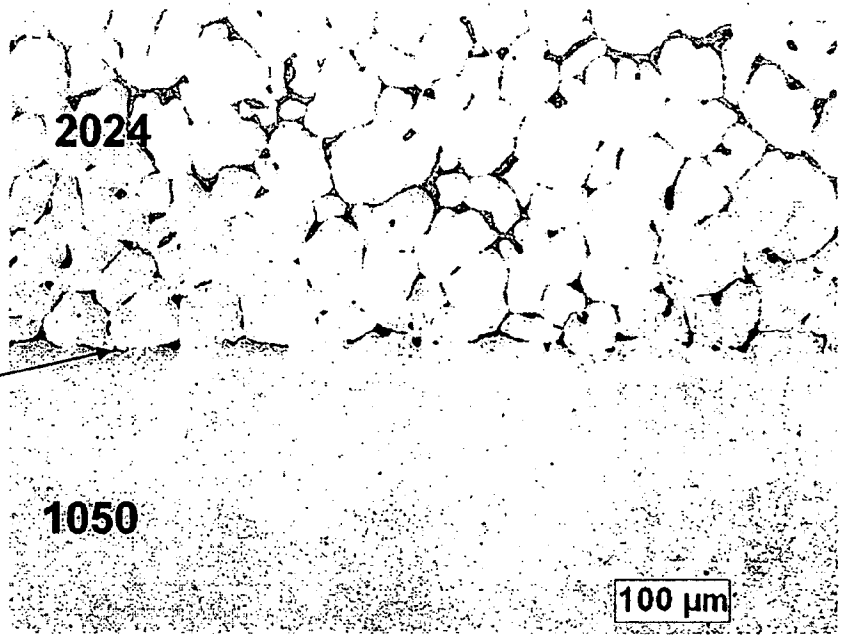
FIG. 19B is a micrograph of the boxed portion of FIG. 19A that shows the interface between the 2024 alloy and 1050 alloy.

FIG. 19B shows a micrograph showing the interface between the 2024 alloy and 1050 alloy of the boxed portion of the three layer multiple layer ingot in FIG. 19A. This shows that the interface between the 2024 alloy and 1050 alloy is well bonded.

Figure 20B:
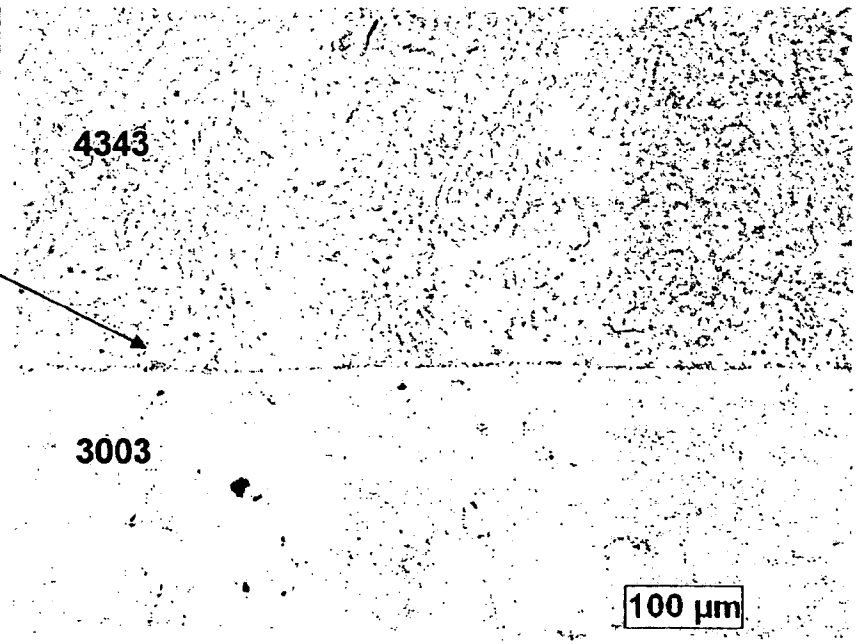
FIG. 20B is a micrograph of the boxed portion of FIG. 20A that shows the interface between the 3003 alloy and 4343 alloy.
Figure 20A:
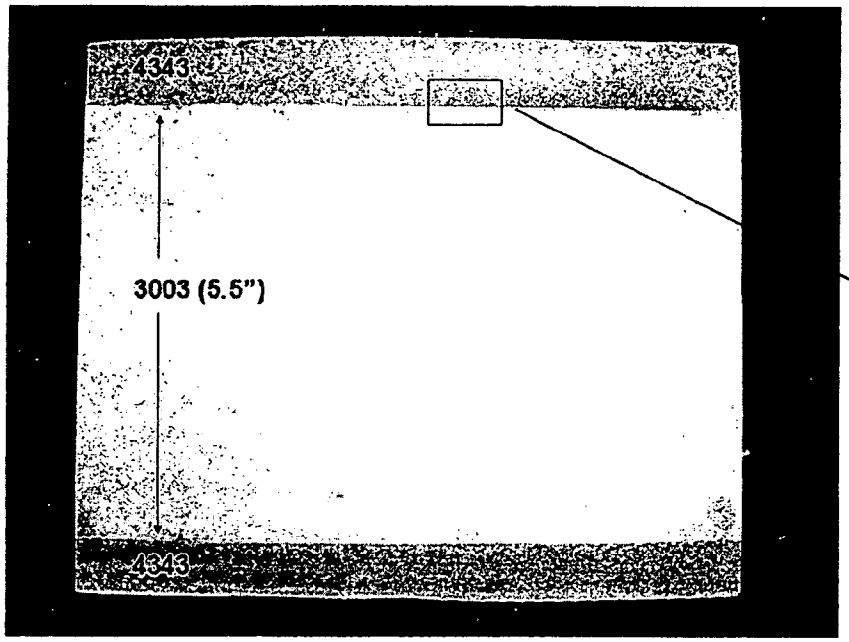
FIG. 20A is a perspective view of a three layer multiple ingot for a brazing sheet product having a 3003 alloy sandwiched between two layers of 4343 alloy.

FIG. 20A shows a three layer multiple layer ingot for a brazing sheet product having a 3003 alloy sandwiched between two layers of 4343 alloy. Here, the 3003 alloy has a liquidus temperature 1211° F. and eutectic temperature of 1173° F. and the 4343 alloy has a liquidus temperature 1133° F. and eutectic temperature of 1068° F. In this example, upon casting a 0.75" thick layer of the first cladding layer of alloy 4343, a 5.5" thick layer of the core alloy 3003 was poured at a controlled rate of 0.7 ipm ensuring that the interface temperature rose to a value between 1018° F. and 1083° F. After casting the cores material, a 0.75" thick second cladding layer of alloy was poured ensuring that the interface temperature rose to a value between 1123° F. and 1211° F.

FIG. 20B shows a micrograph showing the interface between the 3003 alloy and 4343 alloy of the boxed portion of the three layer multiple layer ingot in FIG. 20A. This shows that the interface between the 3003 alloy and 4343 alloy is well bonded.

In the present invention, the multiple layer ingot product is not limited to two or three layers of alloys. The multiple layer ingot product may have more than three layers of alloys.

The present invention therefore provides an apparatus and method for producing directionally solidified ingots, and cooling these ingots at a controlled, relatively constant cooling rate. The invention provides the ability to cast crack-free ingots without the need for stress relief. The method reduces or eliminates macrosegregation, resulting in a uniform microstructure throughout the ingot. The method further produces ingots having a substantially uniform thickness, and which may be thinner than ingots cast using other methods. The large surface area in contact with the coolant results in relatively fast cooling, resulting in higher productivity. The invention provides for a multiple layer ingot wherein no oxide layer exists between the base layer and an additional layer on the base layer.

While specific embodiments of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A multiple layer ingot product comprising:

an ingot having a base aluminum alloy layer and at least a first additional aluminum alloy layer disposed directly on the base layer;

wherein the base layer has a first aluminum alloy composition;

wherein the first additional aluminum alloy layer has a second aluminum alloy composition;

wherein the first aluminum alloy composition and the second aluminum alloy composition are different;

wherein no oxide layer exists between the base layer and the first additional aluminum alloy layer directly disposed on the base layer;

wherein the multiple layer ingot product is made by the following steps comprising:

casting the base aluminum alloy by a planar unidirectional solidification casting process; and applying the first additional aluminum alloy layer in the molten state directly to at least an upper molten portion of the base aluminum alloy layer, wherein the first additional aluminum alloy is also made by a planar unidirectional solidification casting process.

2. The multiple layer ingot product of claim 1, further comprising a second additional aluminum alloy layer.

3. The multiple layer ingot product of claim 2, wherein the second additional aluminum alloy layer is made by a planar unidirectional solidification casting process and is added directly to the first additional aluminum alloy layer by applying the second aluminum alloy in the molten state to at least an upper molten portion of the first additional aluminum alloy.

4. The multiple layer ingot product of claim 3, wherein the base aluminum alloy and the second additional aluminum alloy layers have the same composition.

5. The multiple layer ingot product of claim 3, wherein the base aluminum alloy and the second additional aluminum alloy layers have different alloy compositions.

6. The multiple layer ingot product of claim 4, wherein the multiple layer ingot product is a skin sheet.

7. The multiple layer ingot product of claim 4, wherein the multiple layer ingot product is a brazing sheet.

8. The multiple layer ingot product of claim 5, wherein the multiple layer ingot product is a skin sheet.

9. The multiple layer ingot product of claim 5, wherein the multiple layer ingot product is a brazing sheet.

10. The multiple layer ingot product of claim 1, wherein the base alloy layer is selected from the group consisting of a 1xxx alloy, 2xxx alloy, 3xxx alloy, 4xxx alloy, 5xxx alloy, 6xxx alloy, 7xxx alloy, and 8xxx alloy.

11. The multiple layer ingot product of claim 10, wherein the first additional alloy layer is selected from the group consisting of a 1xxx alloy, 2xxx alloy, 3xxx alloy, 4xxx alloy, 5xxx alloy, 6xxx alloy, 7xxx alloy, and 8xxx alloy.

12. The multiple layer ingot product of claim 3, further comprising a third additional aluminum alloy layer.

13. The multiple layer ingot product of claim 12, wherein the third additional aluminum alloy layer is made by a planar unidirectional solidification casting process and is added directly to the second additional aluminum alloy layer by applying the third additional aluminum alloy in the molten state to at least an upper molten portion of the second additional aluminum alloy layer.

14. The multiple layer ingot product of claim 13, wherein the first aluminum alloy and the third additional aluminum alloy layers have the same composition.

15. The multiple layer ingot product of claim 13, wherein the first aluminum alloy and the third additional aluminum alloy layers have different alloy compositions.

16. The multiple layer ingot product of claim 14, wherein the multiple layer ingot product is a skin sheet.

17. The multiple layer ingot product of claim 14, wherein the multiple layer ingot product is a brazing sheet.

18. The multiple layer ingot product of claim 15, wherein the multiple layer ingot product is a skin sheet.

19. The multiple layer ingot product of claim 15, wherein the multiple layer ingot product is a brazing sheet.

20. The multiple layer ingot product of claim 1, wherein the first additional aluminum alloy is applied to at least an upper molten portion of the as-cast base aluminum alloy layer.

* * * * *